United States Patent [19]

Lassiter

[11] Patent Number: 4,721,249

[45] Date of Patent: Jan. 26, 1988

[54] LOW NOISE SAFETY AIR NOZZLE

[75] Inventor: B. Dean Lassiter, Greensboro, N.C.

[73] Assignee: Burlington Industries, Inc., Greensboro, N.C.

[21] Appl. No.: 864,216

[22] Filed: May 19, 1986

[51] Int. Cl.[4] ..... B05B 1/28; B05B 15/04

[52] U.S. Cl. ..... 239/288.5; 181/198; 222/182; 222/183; 239/397.5

[58] Field of Search ..... 239/288–288.5, 239/DIG. 21, DIG. 22, 397.5; 222/182, 183; 181/198, 200, 210

[56] References Cited

U.S. PATENT DOCUMENTS

| | | | |
|---|---|---|---|
| 3,197,066 | 7/1965 | Denzler et al. | 222/183 X |
| 3,599,876 | 8/1971 | Kyburg | 239/291 |
| 3,647,142 | 3/1972 | Drude et al. | 239/288.3 |
| 3,814,329 | 6/1974 | Clark | 239/426 |
| 3,973,642 | 8/1976 | Dahlquist | 239/DIG. 21 X |
| 4,026,474 | 5/1977 | Knauer et al. | 239/DIG. 22 X |
| 4,036,438 | 7/1977 | Soderlind et al. | 239/288.5 |
| 4,050,632 | 9/1977 | Wyse | 239/DIG. 22 X |
| 4,091,999 | 5/1978 | Voos | 239/DIG. 22 X |
| 4,243,178 | 1/1981 | Self | 239/DIG. 22 X |
| 4,331,296 | 5/1982 | Levey | 239/288 |
| 4,520,949 | 6/1985 | Seitz et al. | 222/183 X |

FOREIGN PATENT DOCUMENTS

| | | | |
|---|---|---|---|
| 2611424 | 9/1977 | Fed. Rep. of Germany | 239/288.5 |

OTHER PUBLICATIONS

Spraco-Lechler, "Whisper Blast", Blow-off Nozzles brochure, WB 1082/3M; 1982.

*Primary Examiner*—Andres Kashnikow
*Assistant Examiner*—Mary Beth O. Jones
*Attorney, Agent, or Firm*—Nixon & Vanderhye

[57] ABSTRACT

A blow-off nozzle assembly provides protection for users, without increasing the noise level, and also protects the nozzle from breakage if dropped. A circular cross-section rod assumes an oblong configuration defining an oblong shaped opening, with circular cross-section support posts extending from one side of the rod. The support posts are received by a casing having channels on opposite sides of a linear array of individual jets of a multi-channel substantially flat jet nozzle. The oblong shaped guard is mounted so that it is spaced from the nozzle in the direction of air flow from the nozzle with a linear array of jets centered within a geometric projection of the opening. The guard prevents deadending, so that the pressure of compressed air if the guard were pressed against a worker's skin would be below the OSHA standard of 30 p.s.i. An outer shell of high impact plastic surrounds the nozzle, with the jets extending from the front end of the shell, and impact absorbing material (such as a plastic foam) is disposed between the shell and nozzle.

18 Claims, 4 Drawing Figures

LOW NOISE SAFETY AIR NOZZLE

BACKGROUND AND SUMMARY OF THE INVENTION

Blow-off nozzles are utilized in many different industries for directing compressed air onto pieces of equipment or work areas for the purpose of cleaning, blowing out, cooling, or otherwise acting upon equipment, cavities, or work surfaces. Recently, types of blow-off nozzles have been developed which comprise multi-channel flat jet nozzles presenting a plurality of individual jets disposed in a generally side-by-side linear array. One of such nozzles is available from Spraco Inc. of Nashua, N.H. and is sold under the trade name "Whisper Blast". Such nozzles have a relatively low noise level, have good blowing power and minimum air consumption, and provide good blowing force performance over a considerable distance as a result of the delivery of laminar air flow. However, such nozzles cannot be used for general blow-off applications in which a workman handles the nozzle and moves to whatever areas he sees fit, since they do not meet the regulations promulgated under the Occupational Safety and Health Act (OSHA).

OSHA requires that compressed air cannot be used for individual cleaning purposes by workmen except when reduced to less than 30 p.s.i. The reason for this is that if the nozzle at conventional compressed air source pressures of 100+ p.s.i. is placed against the body of a human, the high pressure air can penetrate the victim's skin, and is admitted into the blood vessels, which may result in serious injury. The placing of the nozzle against a surface (such as an object or part of a human's body) is referred to as "deadending", and is to be avoided. Thus, nozzles for general purpose cleaning or the like can be utilized pursuant to OSHA regulations only if at the point of delivery of air from the nozzle the pressure is less than 30 p.s.i.

Of course it is desirable to be able to utilize safety devices with nozzles in order to ensure that they cannot be "deadended". However, unless the safety device is carefully constructed and designed, it can result in a significant—and undesirable—increase in noise level. Minimization of the noise level of the nozzle is highly desirable, and a safety device must be able to perform its safety function without occasioning a significant increase in noise level.

According to the present invention, a blow-off nozzle assembly is provided wherein deadending of the nozzle is prevented, but the noise level of the nozzle is not significantly increased. The invention is particularly applicable to a multi-channel, substantially flat jet nozzle as heretofore described, and makes such a nozzle utilizable for general purpose cleaning applications since it meets OSHA requirements. However, the assembly according to the invention also has applicability to other types of nozzles.

According to one aspect of the present invention, a blow-off nozzle assembly is provided which comprises a multi-channel substantially flat jet nozzle as heretofore described and—according to the invention—means for preventing deadending of the nozzle while not significantly increasing the noise level of the nozzle. Such means comprises a generally oblong shaped guard defining a generally oblong shaped opening which is significantly larger than the dimensions of the linear array of jets. Also, means are provided for mounting the guard so that it is spaced from the nozzle in the direction of air flow through the nozzle, and so that the linear array is substantially centered within a geometric projection of the opening. The guard is preferably formed by a continuous circular cross-section rod of high impact plastic (such as nylon), and mounting means include a pair of circular cross-section posts which are integral with the rod and extend from one side thereof. The posts straddle the linear array of jets during use, and preferably are received within channels defined in an outer casing for the nozzle.

It is also desirable to be able to protect the nozzle should it be dropped, since the nozzles are typically subjected to rough handling in general purpose cleaning applications. The nozzle protecting function is nicely integrated with the safety function according to the invention by providing an outer shell of high impact resistant plastic (e.g. nylon) substantially surrounding the nozzle, with the jets extending outwardly from a front end of the casing, and a connection to a source of air under pressure being provided at the rear end of the casing, opposite the front end. Impact absorbing material, such as a plastic foam or rubber, is disposed between the shell and the nozzle, and the shell defines channels for receipt of the guard support posts.

It is the primary object of the present invention to provide a safe and versatile blow-off nozzle assembly without increasing the noise level of the nozzle. This and other objects of the invention will become clear from an inspection of the detailed description of the invention and from the appended claims.

DETAILED DESCRIPTION OF THE DRAWINGS

Figure 1:
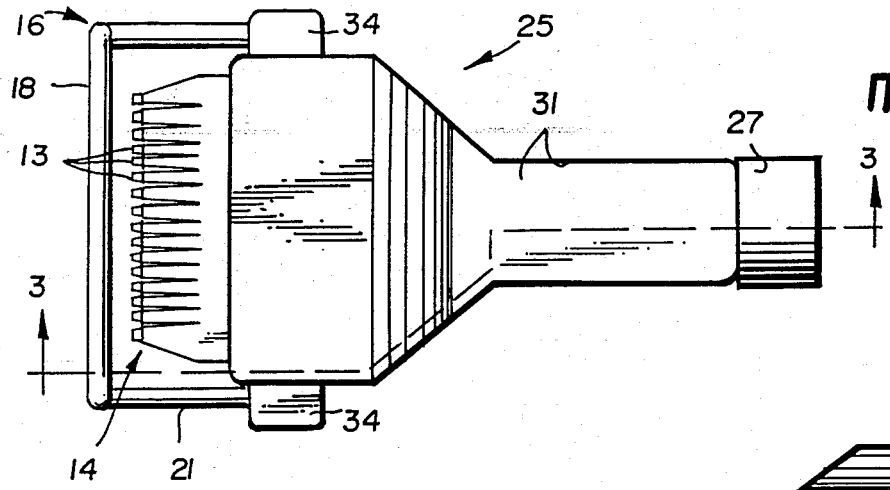
FIG. 1 is a top plan view of an exemplary nozzle assembly according to the present invention.

A nozzle which forms part of the nozzle assembly according to the present invention preferably comprises a conventional multi-channel, substantially flat jet nozzle, such as sold by Spraco, Inc. under the trade name "Whisper Blast". Such a nozzle includes a body 11 (see FIG. 3) of plastic, and has a plurality of individual jets 13 disposed in a generally side-by-side relationship, to provide a linear array of jets, illustrated collectively by the reference numeral 14 in FIGS. 1 and 2. Such multi-channel flat jet nozzles typically have a relatively low noise level, have good blowing force performance over a considerable distance, and have good blowing power.

Figure 2:
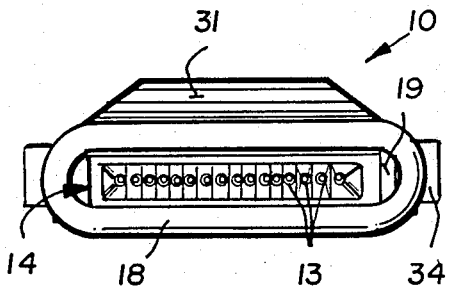
FIG. 2 is a front end view of the assembly of FIG. 1.
Figure 4:
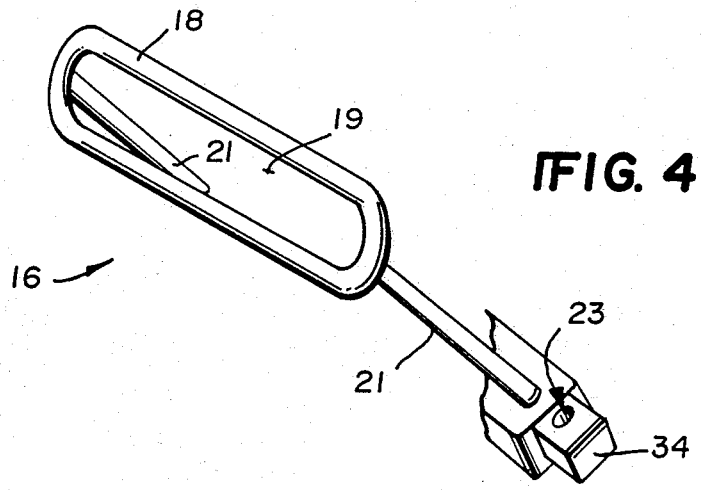
FIG. 4 is a perspective view of the guard of the nozzle assembly of FIGS. 1 through 3, and a perspective schematic showing of a channel for receipt of the support posts thereof.

According to the present invention, means for preventing deadending of the nozzle while not significantly increasing the noise level of the nozzle is illustrated generally by reference numeral 16. The means 16 comprises a guard formed by a closed loop, generally oblong shaped, circular cross-section rod 18 which defines a generally oblong shaped opening 19 (see FIG. 4 in particular) therein. As can be seen in FIG. 2, the opening 19 is significantly larger than the linear array of jets 14.

According to the present invention there also is provided means for mounting the guard 16 so that it is spaced from the nozzle in the direction of air flow from the nozzle, and so that the linear array 14 is substantially centered within a geometric projection of the opening 19 as can be seen in FIG. 2. The means for mounting the guard preferably include the support posts 21, and means defining the channels 23 (only one of which is shown—see FIG. 4) for receipt of the posts 21. The support posts 21 are also circular in cross-section and extend parallel to each other from the same side of (at the ends of the oval of) the guard 16. Preferably the support posts 21 are also of high impact resistant plastic, and the closed loop 18 and support posts 21 are molded of an integral piece of plastic, such as nylon.

To facilitate mounting of guard 16 in proper position, and also to provide protection for the nozzle, a protective casing, shown generally by reference numeral 25, also is provided. The casing 25 substantially surrounds the nozzle body 11, with the jets 13 extending outwardly from the front end of the casing 25, and a connection means 27 being disposed at the rear end of the casing (opposite the front end) for connection of the nozzle body 11 to a source of compressed air.

Figure 3:
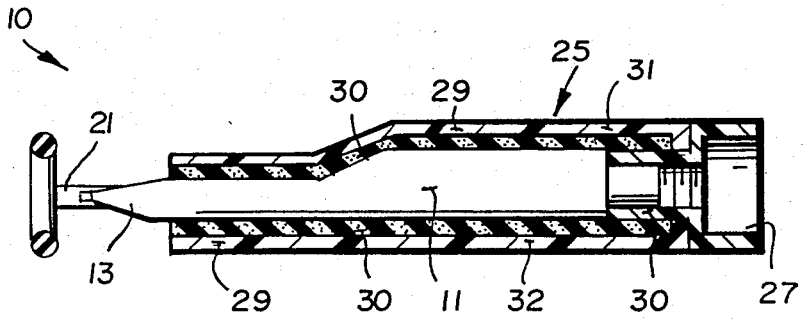
FIG. 3 is a side cross-sectional view of the assembly of FIG. 1, taken along lines 3—3 thereof.

The casing, as most clearly illustrated in FIG. 3, preferably comprises an outer shell 29 of high impact resistant material, such as nylon, and impact absorbing material 30 disposed between the shell 29 and the nozzle body 11. The impact absorbing material may be rubber, plastic foam, or a like material that performs a protecting function. While any suitable construction can be provided for the casing, it is desirable to provide a two-piece casing wherein the top and sides of the nozzle body 11 are covered by one piece 31, and the bottom of the nozzle 11 is covered by a second piece 32 which is glued, ultrasonically welded, screwed, or otherwise attached to the piece 31. (Note that the terms "top", "side", and "bottom" have been used for convenience only, and do not imply any necessary particular orientation).

The casing portion 31 has ears 34 which are also integrally molded therewith. The ears 34 define the channels 23 for receipt of the support posts 21. The structures 21, 34, 23 can be constructed so that the guard 16 is readily removable from the casing 25, or the support posts 21 could be glued, screwed, or otherwise permanently or semi-permanently attached in place.

When the assembly 10 according to the present invention is used for general purpose cleaning functions, deadending is prevented since any attempt to place the jets 13 in contact with a human results instead in the looped rod 18 abutting the human's body. Due to the open area between the guard 16 and the nozzle jets 13, and the spacing therebetween, the maximum pressure at the area where the closed loop rod 18 engages a person's skin is less than 30 p.s.i., assuming that the nozzle 11 is connected up to a conventional shop source of compressed air (which typically has a pressure of about 80–100 p.s.i.), thus meeting the OSHA standards.

Despite the fact that the guard 16 thus will performs a safety (deadending-preventing) function, it does not increase the noise level of the nozzle. For example, in testing of the noise level of a conventional Spraco "Whisper Blast" nozzle with and without the guard 16 according to the present invention, and at different pressures over a range of about 30 p.s.i., the provision of a guard did not increase the noise level of the nozzle more than 0.6 dB at any position or pressure tested, and for most tests at most increased noise levels of 0.2 dB or actually reduced the noise levels. For one position and pressure, a reduction in noise level of 0.2 dB resulted when the guard was employed.

It will thus be seen that according to the present invention a simple yet effective blow-off nozzle assembly has been provided which prevents deadending without significantly increasing nozzle noise, and which protects the nozzle if dropped or otherwise impacted. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and assemblies.

What is claimed is:

1. A blow-off nozzle assembly comprising:

a multi-channel substantially flat air jet nozzle presenting a plurality of individual jets disposed in a generally side-by-side linear array;

means for preventing deadending of said nozzle while not significantly increasing the noise level of the nozzle, said deadending preventing means comprising a generally oblong shaped guard defining a generally oblong shaped opening which is significantly larger than the dimensions of said linear array of jets; and means for mounting said guard so that said oblong shaped opening is spaced a predetermined distance from said nozzle in the direction of air flow from said nozzle such that the noise level of the nozzle does not significantly increase, and said linear array is substantially centered within a geometric projection of said opening.

2. An assembly as recited in claim 1 wherein said guard is formed by a circular cross-section continuous piece of material.

3. An aswembly as recited in claim 2 wherein said guard lies in a plane perpendicular to the direction of air flow, said means for mounting said guard including a pair of posts which are integral with said guard and extend generally normal to said plane.

4. An assembly as recited in claim 3 wherein said posts are circular in cross-section.

5. An assembly as recited in claim 4 wherein said guard and posts comprise an integral piece of high impact plastic.

6. An assembly as recited in claim 5 wherein said high impact plastic is nylon.

7. An assembly as recited in claim 1 further comprising a protective casing for said nozzle, surrounding said nozzle with said jets extending outwardly from a front end of said casing, and a connection to a source of air under pressure disposed at a rear end of said casing opposite the front end.

8. An assembly as recited in claim 7 wherein said casing comprises an outer shell of high impact plastic, with impact absorbing means between said shell and said nozzle.

9. An assembly as recited in claim 8 wherein said impact absorbing material comprises a plastic foam.

10. An assembly as recited in claim 8 wherein the casing of high impact plastic is nylon.

11. An assembly as recited in claim 8 wherein said casing comprises a two piece casing, having a first piece substantially surrounding said nozzle at the sides and top thereof, and a second piece attached to said first piece and covering the bottom of said nozzle.

12. An assembly as recited in claim 3 further comprising a protective casing for said nozzle surrounding said nozzle, with said jets extending outwardly from a front end of said casing, and wherein said means for mounting said guard further comprises means defining channels in said casing on opposite sides of said linear array, each channel for receipt of one of said support posts.

13. An assembly as recited in claim 12 wherein said supports are readily removably and replaceably mounted by said channels.

14. An assembly as recited in claim 1 wherein said guard lies in a plane perpendicular to the direction of air flow, said means for mounting said guard including a pair of posts which are integral with said guard and extend generally normal to said plane, the noise level of said flat air jet nozzle operating at no more than about 30 psi at said prevention means affording a reduction in noise level or an increase thereof no more than 0.6 dB in comparison with the noise level of said flat air jet nozzle without said prevention means.

15. A blow-off nozzle assembly comprising:

a nozzle including air jet means for delivering at least one stream of air under pressure in a given direction;

means for preventing deadending of said nozzle while not significantly increasing the noise level of the nozzle, said deadending preventing means comprising a guard having a closed loop circular cross-section rod defining an opening and lying in a plane generally normal to said given direction; and means for mounting said guard so that said guard opening is spaced a predetermined distance from said nozzle in the direction of air flow from said nozzle such that the noise level of the nozzle does not significantly increase;

said mounting means including circular cross-section support posts integral with said closed loop rod and extending generally normal to said plane and means for receiving said support posts on opposite sides of said nozzle and cooperating with said support posts to mount said closed loop rod with air from said nozzle passing through said opening of said closed loop rod.

16. An assembly as recited in claim 15 wherein said guard has a generally oblong shape, defining a generally oblong-shaped opening, and wherein said nozzle comprises a multi-channel substantially flat air jet nozzle presenting a plurality of individual jets disposed in a generally side-by-side linear array.

17. An assembly as recited in claim 16 wherein said guard and support posts comprise an integral piece of plastic material having impact resistance properties comparable to those of nylon.

18. An assembly as recited in claim 15 further comprising a protective casing for said nozzle surrounding said nozzle, with at least one jet of said nozzle extending outwardly from a front end of said casing, with connection means for connecting said nozzle to an air source disposed at a rear end of said casing, opposite said front end; said casing including an outer shell of high impact plastic material, and impact absorbing means between said shell and said nozzle; and said casing having means defining channels on opposite sides of said at least one jet extending from the front end of said casing, each channel for receipt of one of said support posts.

* * * * *